US007623810B2

(12) United States Patent
Fukunaga et al.

(10) Patent No.: US 7,623,810 B2
(45) Date of Patent: Nov. 24, 2009

(54) ELECTROPHOTOGRAPHIC PHOTOSENSITIVE MEMBER AND IMAGE FORMING APPARATUS PROVIDED WITH THE SAME

(75) Inventors: Hideaki Fukunaga, Higashiomi (JP); Yoshinobu Ishii, Higashiomi (JP)

(73) Assignee: Kyocera Corporation, Kyoto (JP)

( * ) Notice: Subject to any disclaimer, the term of this patent is extended or adjusted under 35 U.S.C. 154(b) by 475 days.

(21) Appl. No.: 11/588,846

(22) Filed: Oct. 27, 2006

(65) Prior Publication Data

US 2007/0154239 A1 Jul. 5, 2007

(30) Foreign Application Priority Data

Oct. 28, 2005 (JP) ..... 2005-314101
Nov. 29, 2005 (JP) ..... 2005-343498
Dec. 26, 2005 (JP) ..... 2005-372415

(51) Int. Cl.
*G03G 15/00* (2006.01)
*G03G 15/02* (2006.01)
*G03G 21/00* (2006.01)

(52) U.S. Cl. ..... 399/159; 399/176; 399/350

(58) Field of Classification Search ..... 399/159, 399/174, 176, 350; 430/56, 66
See application file for complete search history.

(56) References Cited

U.S. PATENT DOCUMENTS

| | | | | |
|---|---|---|---|---|
| 5,774,767 | A | 6/1998 | Shibata et al. | |
| 5,983,055 | A * | 11/1999 | Bito et al. | 399/159 |
| 6,189,380 | B1 | 2/2001 | Yamakawa et al. | |
| 6,226,479 | B1 * | 5/2001 | Karaki et al. | 399/159 |
| 2003/0175604 | A1 | 9/2003 | Morikawa et al. | 430/58.8 |
| 2007/0154239 | A1 | 7/2007 | Fukunaga et al. | 399/159 |

FOREIGN PATENT DOCUMENTS

| | | |
|---|---|---|
| JP | 57-115551 | 7/1982 |
| JP | 62-258466 | 11/1987 |
| JP | 62-272275 | 11/1987 |
| JP | 06-019230 | 1/1994 |
| JP | 06-266203 | 9/1994 |
| JP | 07-134427 | 5/1995 |
| JP | 09185291 A | 7/1997 |

(Continued)

OTHER PUBLICATIONS

Japanese office actions with translation.

(Continued)

*Primary Examiner*—William J Royer
(74) *Attorney, Agent, or Firm*—Hogan & Hartson LLP

(57) ABSTRACT

The present invention relates to an electrophotographic photosensitive member and an image forming apparatus provided with the same. The electrophotographic photosensitive member includes a substantially cylindrical body and a photosensitive layer having a latent image forming area formed on the body. The photosensitive layer includes a first end in the axial direction of the latent image forming area and a second end located opposite to the first end in the axial direction. The first end is pressed harder than the second end. In the photosensitive layer, thickness or dynamic indentation hardness at the first end at one side of the latent image forming area is larger than thickness or dynamic indentation hardness at the second end located opposite to the first end in the axial direction of the latent image forming area.

36 Claims, 12 Drawing Sheets

FOREIGN PATENT DOCUMENTS

| | | | |
|---|---|---|---|
| JP | 11-160895 | | 6/1999 |
| JP | 11-231721 | | 8/1999 |
| JP | 11272122 | A | 10/1999 |
| JP | 11-343573 | | 12/1999 |
| JP | 2000-162939 | | 6/2000 |
| JP | 2001316825 | A | 11/2001 |
| JP | 2003-241408 | | 8/2003 |
| JP | 2003-248333 | | 9/2003 |
| JP | 2003-316054 | | 11/2003 |
| JP | 2004-239990 | | 8/2004 |

OTHER PUBLICATIONS

Japanese language office action and its English language translation for corresponding Japanese application 2006292937 lists the references above.

* cited by examiner

ELECTROPHOTOGRAPHIC PHOTOSENSITIVE MEMBER AND IMAGE FORMING APPARATUS PROVIDED WITH THE SAME

TECHNICAL FIELD

The present invention relates to an electrophotographic photosensitive member and an image forming apparatus provided with the same.

BACKGROUND ART

An image forming apparatus such as a copying machine and a printer utilizing an electrophotographic method is provided with an electrophotographic photosensitive member. In such image forming apparatus, the electrophotographic photosensitive member is rotated by a power transmitter, and synchronously with the rotation, operations such as electrification, exposure, development, transfer, and cleaning are repeated, thereby forming an image on a recording medium.

Specifically, in the image forming apparatus, the electrophotographic photosensitive member is electrically charged at its surface and then rotated while being irradiated by laser light for exposure, according to an image pattern, so that an electrostatic latent image is formed on the surface of the electrophotographic photosensitive member. Next, the latent image is developed by attaching toner to the electrophotographic photosensitive member. The toner attached to the electrophotographic photosensitive member is transferred to a recording medium. After the transfer of toner to the recording medium, the electrophotographic photosensitive member is rotated while a cleaning blade is pressed onto the surface of the electrophotographic photosensitive member, so that remaining toner is removed.

The electrophotographic photosensitive member includes a metal cylindrical body on which a photosensitive layer is formed. The photosensitive layer includes a photoconductive layer formed on the cylindrical body and containing inorganic material and a surface layer containing inorganic material to coat the photoconductive layer, and has a constant thickness in the axial direction of the cylindrical body. Here, the constant thickness means that the ratio of a thickness at any portion other than one end of the electrophotographic photosensitive member to a thickness at an end of the electrophotographic photosensitive member the one end is not less than 0.999 and not more than 1.001.

As shown in FIG. 12, an electrophotographic photosensitive member 8 includes an end 80 to which rotation energy is applied by a power transmitter 81, and an end 82 rotatably supported by a bearing flange 83.

The power transmitter 81 includes a power transmitting flange 84 fixed to the electrophotographic photosensitive member 8 and a gear 85 engaging with the power transmitting flange 84. The power transmitting flange 84 is firmly fixed to an inside low portion 86 of the electrophotographic photosensitive member 8 for rotating the electrophotographic photosensitive member 8. On the other hand, the bearing flange 83 allows the rotation of the electrophotographic photosensitive member 8, and not to prevent the rotation, is arranged to have a play (gap) 88 relative to an inside low portion 87 of the electrophotographic photosensitive member 8.

An image forming apparatus 9 is provided with a cleaning blade 90 for removing remaining toner from the electrophotographic photosensitive member 8. As described above, the cleaning blade 90 presses the electrophotographic photosensitive member 8 while the electrophotographic photosensitive member 8 is rotated, thereby removing the remaining toner. Thus, the cleaning blade 90 is attached via urging means such as springs 91 for pressing the surface of the electrophotographic photosensitive member 8.

As described above, the power transmitting flange 84 is firmly fixed to the inside low portion 86 of the electrophotographic photosensitive member 8, while the bearing flange 83 is attached to the inside low portion 87 of the electrophotographic photosensitive member 8 with the gap 88. With such arrangement, when the cleaning blade 90 presses the surface of the electrophotographic photosensitive member 8 for removing the remaining toner thereof, pressing force applied to the end 80 (at the side of the power transmitting flange 84) of the electrophotographic photosensitive member 8 tends to be larger than the pressing force applied to the end 82 (at the side of the bearing flange 83)

As a result, if a foreign object such as dust is caught between the electrophotographic photosensitive member 8 and the cleaning blade 90, the photosensitive layer (the surface layer and the photoconductive layer) is likely to be broken at the end 80 (at the side of the power transmitting flange 84) of the electrophotographic photosensitive member 8 than that at the end 82 (at the side of the bearing flange 83). Especially, when the cleaning blade 90 made of a material having relatively high hardness (JIS hardness of not less than 67 degrees and not more than 84 degrees) presses the surface layer made of a material containing inorganic material with high hardness such as amorphous silicon, the end 82 (at the side of the bearing flange 83) is likely to be broken. If the photoconductive layer of the photosensitive layer is broken and the crack extends to the cylindrical body, electrification charge originally existing on the surface of the photosensitive member moves to the cylindrical body through the crack (providing electrical short circuit), thereby forming a defective image on a recording medium.

The problem may be caused not only when the bearing flange 83 is attached to the inside low portion 87 of the electrophotographic photosensitive member 8 with the gap 88. Specifically, even when a bearing flange (without a shaft) is firmly fixed to the electrophotographic photosensitive member and a shaft is inserted into a through-hole formed at the bearing flange via a bearing, a problem similar to the above-described one may be caused due to a slight play at the bearing.

Patent Document 1: JP-A-6-19230

Patent Document 2: JP-A-2004-239990

Patent Document 3: JP-A-62-272275

DISCLOSURE OF THE INVENTION

An object of the present invention is to prevent a photosensitive layer of an electrophotographic photosensitive member from being broken at a side of a power transmission flange, so that no defective image is formed.

An electrophotographic photosensitive member according to one aspect of the present invention is rotatably to be supported in an image forming apparatus.

The electrophotographic photosensitive member comprises a substantially cylindrical body and a photosensitive layer with a latent image forming area formed on the body.

The photosensitive layer comprises a first end in an axial direction of the latent image forming area and a second end opposite to the first end in the axial direction. The first end is pressed harder than the second end when the electrophotographic photosensitive member is incorporated in the image forming apparatus. The photo sensitive layer has thickness or dynamic indentation hardness larger at the first end than at the second end.

An image forming apparatus according to one aspect of the present invention comprises a pressing member and an electrophotographic photosensitive member including a photosensitive layer.

The pressing member presses the photosensitive layer at a first end of the photosensitive layer harder than a second end located opposite to the first end in the axial direction of the photosensitive layer.

The electrophotographic photosensitive member includes a cylindrical body on which the photosensitive layer is formed. The photosensitive layer has thickness or dynamic indentation hardness larger at the first end than at the second end.

BEST MODE FOR CARRYING OUT THE INVENTION

An image forming apparatus and an electrophotographic photosensitive member according to the present invention are specifically described below with reference to the accompanying drawings.

Figure 1:
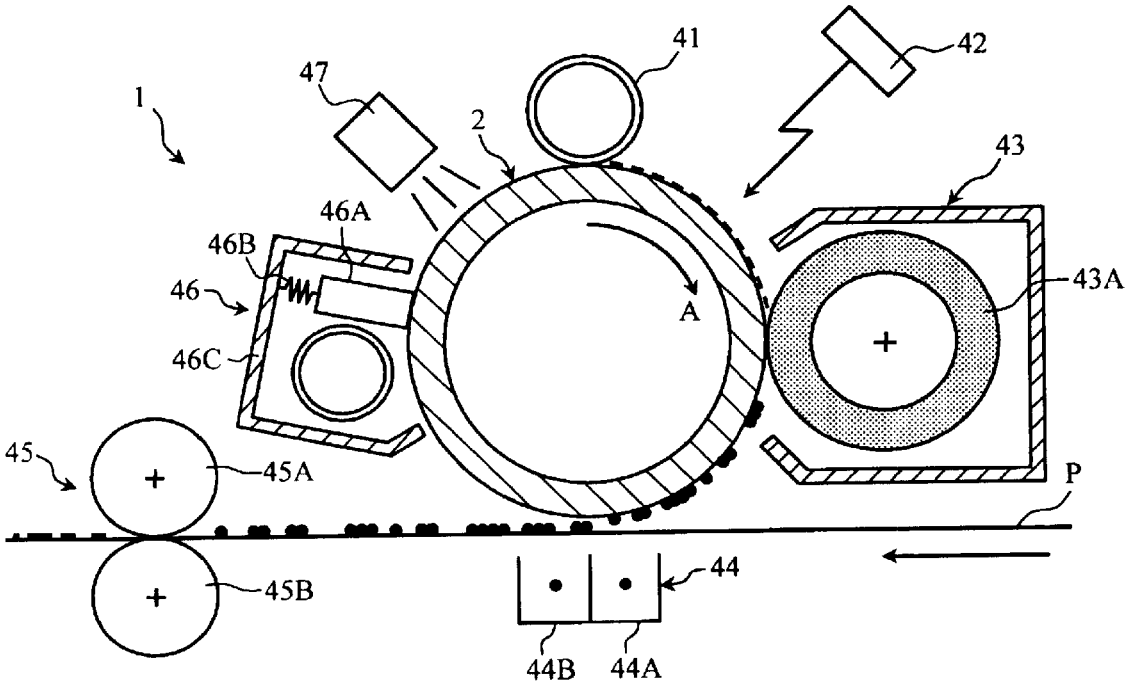
FIG. 1 is a schematic view illustrating an example of an image forming apparatus according to the present invention.
Figure 2:
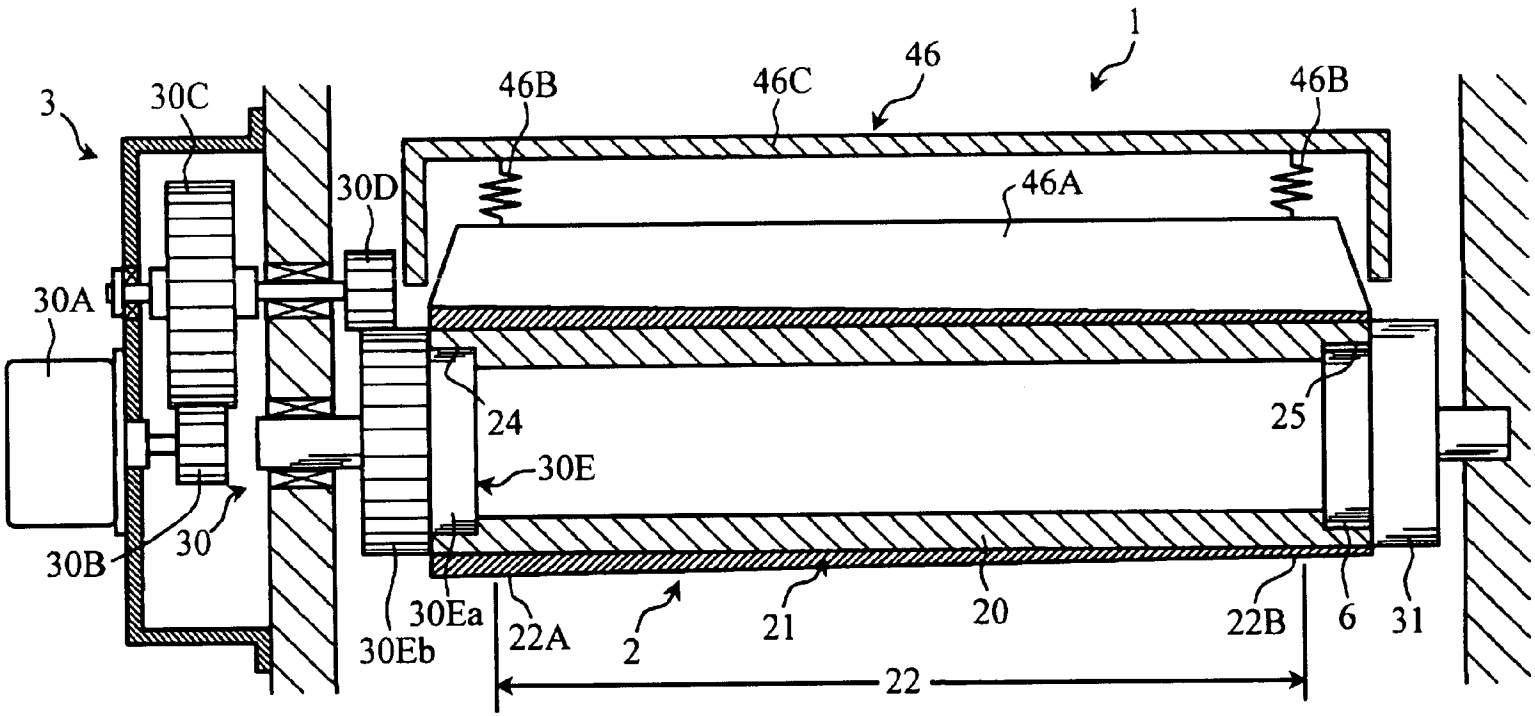
FIG. 2 is a sectional view illustrating the arrangement of an electrophotographic photosensitive member and a cleaning mechanism.

An image forming apparatus 1 shown in FIGS. 1 and 2 utilizes the Carlson method for image forming, and includes an electrophotographic photosensitive member 2, a rotation mechanism 3, an electrification roller 41, an exposure mechanism 42, a development mechanism 43, a transfer mechanism 44, a fixing mechanism 45, a cleaning mechanism 46, and a discharging mechanism 47.

Figure 3:
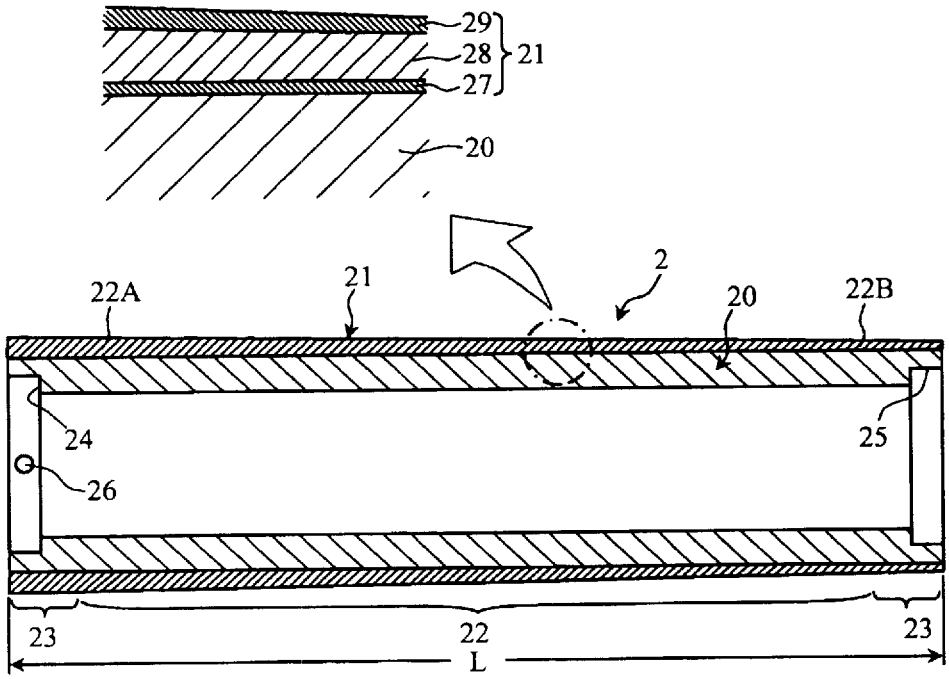
FIG. 3 is a sectional view and an enlarged view of the principal portions, illustrating the electrophotographic photosensitive member according to the present invention.

As shown in FIG. 2, the electrophotographic photosensitive member 2 forms an electrostatic latent image or a toner image according to an image signal, and can be rotated in the direction of an arrow A in FIG. 1, by the rotation mechanism 3. As shown in FIG. 3, the electrophotographic photosensitive member 2 includes a cylindrical body 20 having a surface on which a photosensitive layer 21 is formed.

The cylindrical body 20 forms the skeleton of the electrophotographic photosensitive member 2 and holds the electrostatic latent image on its outer circumference. The axis 7 of the cylindrical body 20 has a length L slightly longer than the maximum length of a recording medium P such as a recording paper to be used. Specifically, the length L of the axis is set so that the cylindrical body 20 extends beyond the ends of the recording medium P by not less than 0.5 cm and not more than 5 cm. Thus, the photosensitive layer 21 includes a latent image forming area 22 corresponding to the maximum length of the recording medium P, and non-latent image forming areas 23 provided at the ends of the cylindrical body 20, next to the latent image forming area 22. The non-latent image forming areas 23 are the areas of the photosensitive layer 21 (at the outside of the latent image forming area 22 in the axial direction) which are never to be used in forming a latent image of any size on the photosensitive layer 21.

The cylindrical body 20 is provided with inside low portions 24, 25 having a relatively large inner diameter, and a mark 26. The inside low portion 24 is a portion to which a power transmitting flange 30E, which is to be described later, of the rotation mechanism 3 is fitted, while the inside low portion 25 is a portion to which a bearing flange 31, which is to be described later, of the rotation mechanism 3 is fitted. The illustrated inside low portions 24, 25 are arranged within areas corresponding to the non-latent image forming areas 23, though may extend to an area corresponding to the latent image forming area 22.

The mark 26 serves to distinguish the inside low portions 24, 25 of the electrophotographic photosensitive member 2 from each other. The mark 26 is formed on the inner surface of the inside low portion 24. It suffices if the mark 26 is visible, and the mark 26 may be formed by attaching a seal, by forming a recess by applying pressing force, or by scratching using a cutting tool. The mark 26 may be formed at the inside low portion 25, or at an end surface of the cylindrical body 20. As described below, in the photosensitive layer 21, the thickness at an end 22A at the side of the inside low portion 24 is larger than the thickness at an end 22B at the side of the inside low portion 25. By providing the mark 26 to the cylindrical body 20, it becomes easy to recognize the end 22A at the side of the inside low portion 24 where the thickness of the photosensitive layer 21 is relatively large. As a result, when incorporating the electrophotographic photosensitive member 2 into the image forming apparatus 1, it can be prevented that the electrophotographic photosensitive member 2 is arranged in a wrong orientation.

The cylindrical body 20 is conductive at least on its surface. Specifically, the cylindrical body 20 may be made of a conductive material as a whole, or may be made of an insulating material having a conductive film formed thereon. The conductive material for forming the cylindrical body 20 may include metal such as Al or SUS (stainless), Zn, Cu, Fe, Ti, Ni, Cr, Ta, Sn, Au, and Ag, and an alloy of these metals, for example. The insulating material for forming the cylindrical body 20 may include resin, glass, and ceramic. The material for forming the conductive film may include a transparent conductive material such as ITO (Indium Tin Oxide) and $SnO_2$, other than the above-described metals. The transparent conductive material can be deposited on the surface of the insulating cylindrical body, utilizing a conventional method such as vapor deposition. Preferably, the cylindrical body 20 is formed of Al alloy material as a whole. In this way, the electrophotographic photosensitive member 2 having a light weight can be made at a low cost, and further, the adhesion between an anti-charge injection layer 27 and a photoconductive layer 28, both to be described below, of the photosensitive layer 21 is reliably enhanced when forming the layers 27, 28 by amorphous silicon (a-Si) material.

The photosensitive layer 21 includes the anti-charge injection layer 27, in addition to the photoconductive layer 28 and the surface layer 29 laminated together. In the latent image forming area 22 of the photosensitive layer 21, the thickness at the first end 22A at the side of the power transmitting flange 30E, which is to be described later, of the rotation mechanism 3 is larger than the thickness at the second end 22B at the side of the bearing flange 31, which is to be described later, of the rotation mechanism 3, whereby dynamic indentation hardness is larger at the first end 22A.

In the photosensitive layer 21, the ratio of dynamic indentation hardness at the first end 22A to dynamic indentation hardness at the second end 22B is, for example, not less than 1.03 to 1 and not more than 1.25 to 1. The difference between the dynamic indentation hardness at the first end 22A and at the second end 22B is not less than 25 and not more than 170.

Here, the dynamic indentation hardness of the photosensitive layer 21 indicates a value measured by a dynamic indentation hardness method. Such dynamic indentation hardness can be obtained by measuring a piece of the electrophotographic photosensitive member 2 cut into a size of 10 mm×20 mm, utilizing "DynamicUltraMicroHardness Tester—201" (manufactured by SHIMADZU CORPORATION). In using this tester, a 115° triangular pyramid is used as an indenter, and measurement conditions are set to have indention depth of 100 nm, load range of 19.6 mN, load rate of 0.284393 mN, and holding time of 5 seconds.

The anti-charge injection layer 27 serves to prevent injection of electrons and electron holes from the cylindrical body 20 into the photoconductive layer 28, and various types of anti-charge injection layer 27 may be used depending on the material of the photoconductive layer 28. The anti-charge injection layer 27 may be made of an inorganic material, for example, and if using a-Si material for the photoconductive layer 28, the anti-charge injection layer 27 may also be made of an inorganic material such as a-Si material. In this way, an electrophotographic photosensitive property with enhanced adhesiveness between the cylindrical body 20 and the photoconductive layer 28 can be obtained.

Informing the anti-charge injection layer 27 using a-Si material, the material may contain a thirteenth group element of the periodic system (hereinafter referred to as "thirteenth group element") or a fifteenth group element of the periodic system (hereinafter referred to as "fifteenth group element") in an amount larger than those contained in the photoconductive layer 28 of a-Si material so as to determine the conductivity type. Further, a large amount of boron (B), nitrogen (N), or oxygen (O) may be also contained so as to have high resistivity.

Note that the anti-charge injection layer 27 is optional and is not always necessary. The anti-charge injection layer 27 may be replaced with a long-wavelength light absorbing layer. The long-wavelength light absorbing layer prevents a long-wavelength light (light of a wavelength of not less than 0.8 μm) entering on exposure from reflecting on the surface of the cylindrical body 20, and thus prevents a fringe pattern generated at a formed image.

In the photoconductive layer 28, electrons are excited by a laser irradiation from the exposure mechanism 42, and a carrier of free electrons or electron holes is generated. The photoconductive layer 28 is formed of a-Si material, amorphous selenium material such as a-Se, Se—Te, and $As_2Se_3$ or a chemical compound of a twelfth group element and a sixteenth group element of the periodic system such as ZnO, CdS, and CdSe, for example. As the a-Si material, a-Si, a-SiC, a-SiN, a-SiO, a-SiGe, a-SiCN, a-SiNO, a-SiCO or a-SiCNO may be used. Especially when the photoconductive layer 28 is made of a-Si, or an a-Si alloy material of a-Si and an element such as C, N, and O, it is able to have high luminous sensitivity, high-speed responsiveness, stable repeatability, high heat resistance, high endurance, and so on, thereby reliably obtaining an enhanced electrophotographic property. Further, in addition to the above condition, by forming the surface layer 29 using a-SiC:H, conformity of the photoconductive layer 28 with the surface layer 29 is enhanced. The photoconductive layer 28 may be also formed by changing the above-described inorganic material into particles, and by dispersing the particles in a resin, or may be formed as an OPC photoconductive layer.

In forming the photoconductive layer 28 using an inorganic material as a whole, it can be formed by conventional film formation methods such as a glow discharge decomposition method, various sputtering methods, various vapor deposition methods, an ECR method, a photo-induced CVD method, a catalyst CVD method, and a reactive vapor deposition method, for example. In film forming of the photoconductive layer 28, hydrogen (H) or a halogen element (F, C1) may be contained in the film by not less than one atom % and not more than 40 atom % for dangling-bond termination. Further, in forming the photoconductive layer 28, for obtaining a desired property such as an electrical property including e.g. dark conductivity and photoconductivity as well as an optical bandgap in respective layers, not less than 0.1 ppm and not more than 20000 ppm of a thirteenth group element or a fifteenth group element, or not less than 0.01 ppm and not more than 100 ppm of an element such as C, N, and O may be contained. The elements C, N, and O may be contained such that a concentration gradient is generated in the thickness direction of the layers, if the average content of the elements in the layers is within the above-described range.

As the thirteenth group element and the fifteenth group element, in view of high covalence and sensitive change of semiconductor property, as well as of high luminous sensitivity, it is desired to use boron (B) and phosphorus (P). When the thirteenth group element and the fifteenth group element are contained in combination with elements such as C, N, and O, preferably, the thirteenth group element may be contained by not less than 0.1 ppm and not more than 20000 ppm, while the fifteenth group element may be contained by not less than 0.1 ppm and not more than 10000 ppm.

When the photoconductive layer 28 contains none or only a small amount (not less than 0.01 ppm and not more than 100 ppm) of the elements such as C, N, and O, preferably, the thirteenth group element may be contained by not less than 0.1 ppm and not more than 200 ppm, while the fifteenth group element may be contained by not less than 0.01 ppm and not more than 100 ppm. These elements may be contained in a manner that a concentration gradient is generated in the thickness direction of the layers, if the average content of the elements in the layers is within the above-described range.

In forming the photoconductive layer 28 using a-Si material, μc-Si (microcrystal silicon) may be contained, which enhances dark conductivity and photoconductivity, and thus advantageously increases design freedom of the photoconductive layer 28. Such μc-Si can be formed by utilizing a method similar to the above-described method, and by changing the film forming condition. For example, when utilizing a glow discharge decomposition method, the layer can be formed by setting temperature and high-frequency electricity at the cylindrical body 20 higher than in the case using only a-Si, and by increasing flow amount of hydrogen as diluent gas. Further, impurity elements similar to the above-described elements may be added when μc-Si is contained.

The thickness of the photoconductive layer 28 may be determined according to a photoconductive material and a desired electrophotographic property, at least the thickness at the first end 22A at the side of the power transmitting flange 30E in the latent image forming area 22 is larger than the thickness at the second end 22β at the side of the bearing flange 31 in the latent image forming area 22. The thickness of the photoconductive layer 28 gradually becomes larger as proceeding from the second end 22S toward the first end 22A. The thickness of the photoconductive layer 28 may also become larger stepwise from the second end 22B toward the first end 22A.

In the photoconductive layer 28, the ratio of the thickness at the first end 22A to the thickness at the second end 22B is not less than 1.03 and not more than 1.25. In forming the photoconductive layer 28 using a-Si material, the thickness at the first end 22A is set to not less than 5.15 μm and not more than 125 μm, preferably not less than 15.45 μm and not more than 100 μm, while the thickness at the second end 22B is set to not less than 5 μm and not more than 100 μm, preferably not less than 15 μm and not more than 50 μm. In the photoconductive layer 28, the difference between the thickness at the first end 22A and at the second end 22B is set to not less than 1.0 μm and not more than 7.5 μm, preferably not less than 3.5 μm and not more than 5.0 μm.

Here, when the axial length of the cylindrical body 20 is L, the first end 22A in the latent image forming area 22 is spaced from an end of the photosensitive layer 21 by not less than 0.1 L and not more than 0.25 L in the axial direction of the cylindrical body 20, while the second end 22B in the latent image forming area 22 is spaced from another end of the photosensitive layer 21 by not less than 0.75 L and not more than 0.9 L in the axial direction of the cylindrical body 20.

Here, the thickness of the photoconductive layer 28 at each of the first and second ends 22A, 22B in the latent image forming area 22 is an average value of thickness measured at any five points along the circumference of each of the ends 22A, 22B. However, in measuring the thickness, particular portions with defective film or broken film are not measured. The thickness of the photoconductive layer 28 is calculated by optical interferometry. Specifically, light at not less than 1000 nm and not more than 1100 nm is entered into the target portions to obtain a light transmission curve, so that the thickness is calculated based on the maximum and minimum of the transmission curve and on the refractive index at the surface layer (reference document: page 42-46 of "Measurement and Evaluation of Thin Layer Material" issued by TECHNICAL INFORMATION INSTITUTE CO., LTD).

Figure 4:
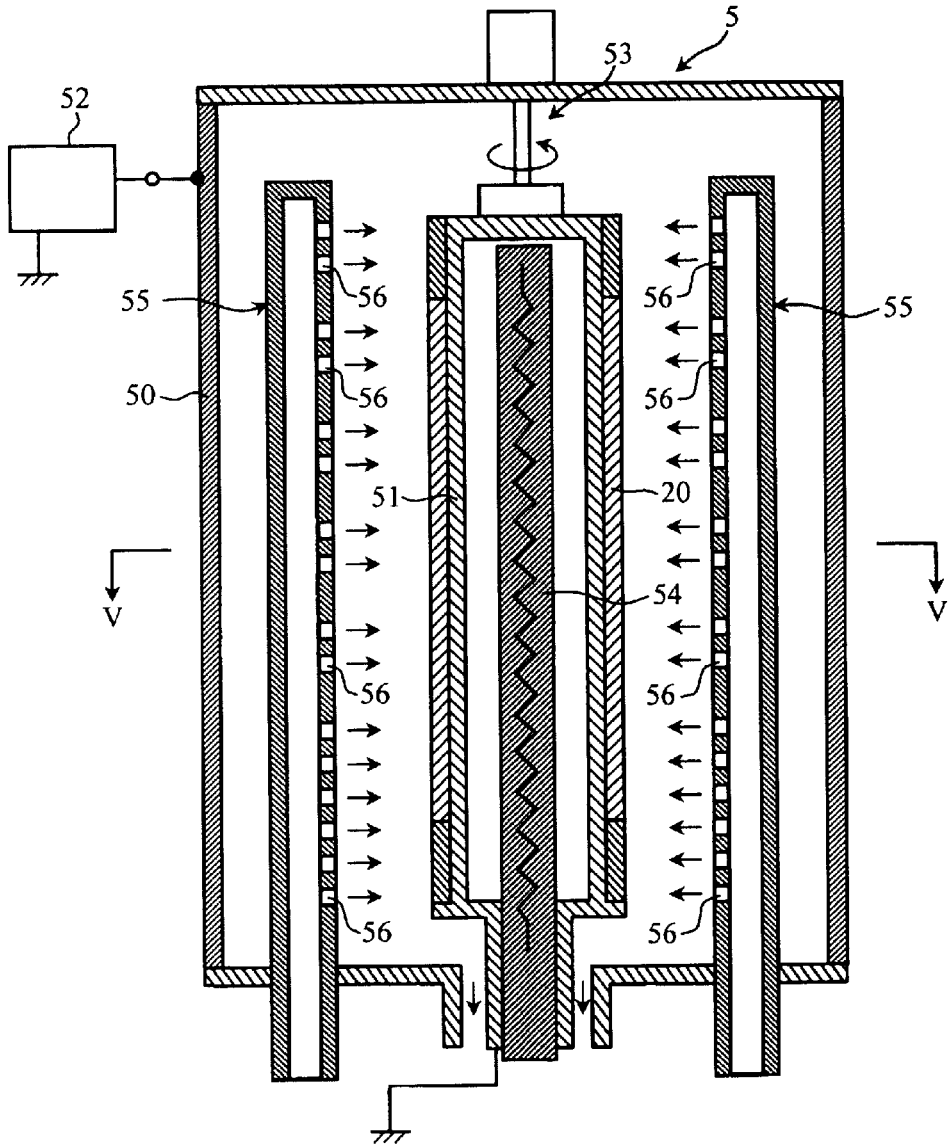
FIG. 4 is a sectional view illustrating an example of a glow discharge decomposition device for manufacturing the electrophotographic photosensitive member.
Figure 5:
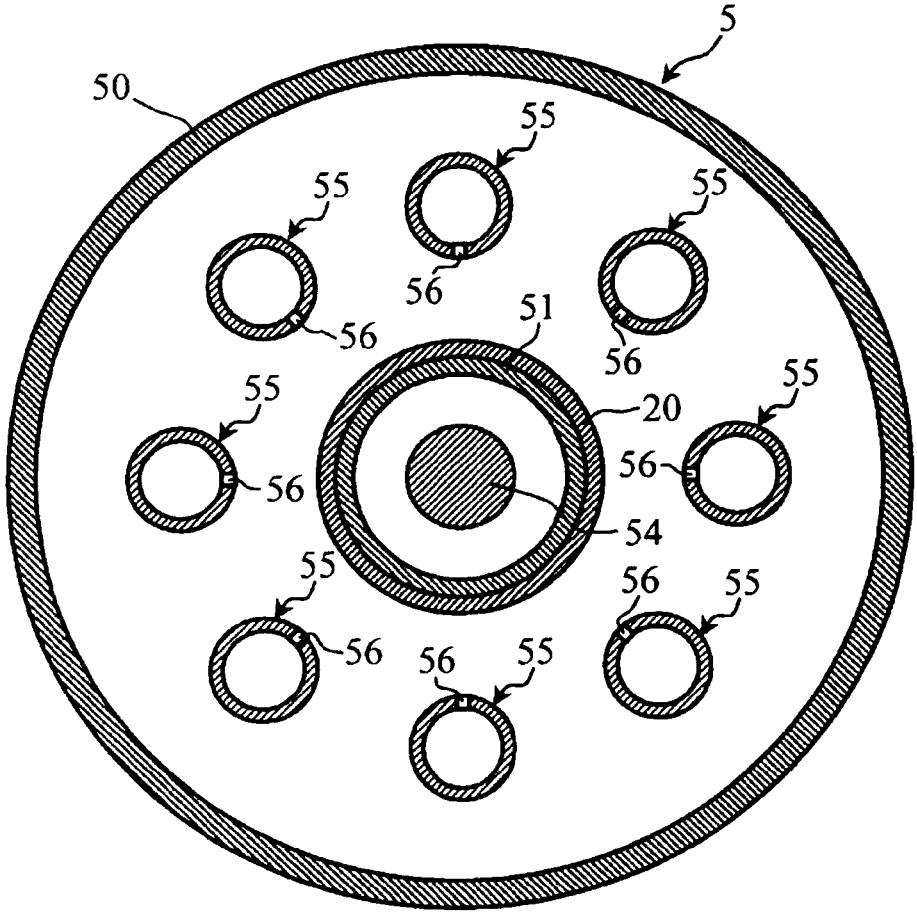
FIG. 5 is a sectional view taken along lines V-V of FIG. 4.

Such photoconductive layer 28 can be formed by a glow discharge decomposition device 5 shown in FIGS. 4 and 5, for example. The illustrated glow discharge decomposition device 5 includes a cylindrical vacuum container 50 having an intermediate portion provided with a supporting member 51 for supporting the cylindrical body 20. By glow discharge plasma, a-Si film is formed on the cylindrical body 20. In the glow discharge decomposition device 5, the supporting member 51 is grounded and the vacuum container 50 is connected to a high-frequency power source 52 for applying high-frequency power between the vacuum container 50 and the supporting member 51 (cylindrical body 20). The supporting member 51 can be rotated by a rotating mechanism 53, and heated by a heater 54 provided therein. The glow discharge decomposition device 5 further includes a plurality (eight in the figure) of gas inlet tubes 55 surrounding the supporting member 51 (cylindrical body 20). Each of the gas inlet tubes 55 is provided with a plurality of gas inlet ports 56 aligned in the axial direction. The gas inlet ports 56 of the gas inlet tube 55 are positioned to face the cylindrical body 20, so that material gas introduced through the gas inlet ports 56 is blown out toward the cylindrical body 20.

In forming a-Si film on the cylindrical body 20 using the glow discharge decomposition device 5, material gas of predetermined amount and gas ratio is introduced into the cylindrical body 20 through the gas inlet ports 56 of the gas inlet tubes 55. Here, the cylindrical body 20 together with the supporting member 51 is rotated by the rotating mechanism 53. The high-frequency power source 52 applies high-frequency power between the vacuum container 50 and the supporting member 51 (cylindrical body 20), and glow discharge is performed to decompose the material gas, so that a-Si film is formed on the cylindrical body 20 which is set at a desired temperature.

Figure 6:
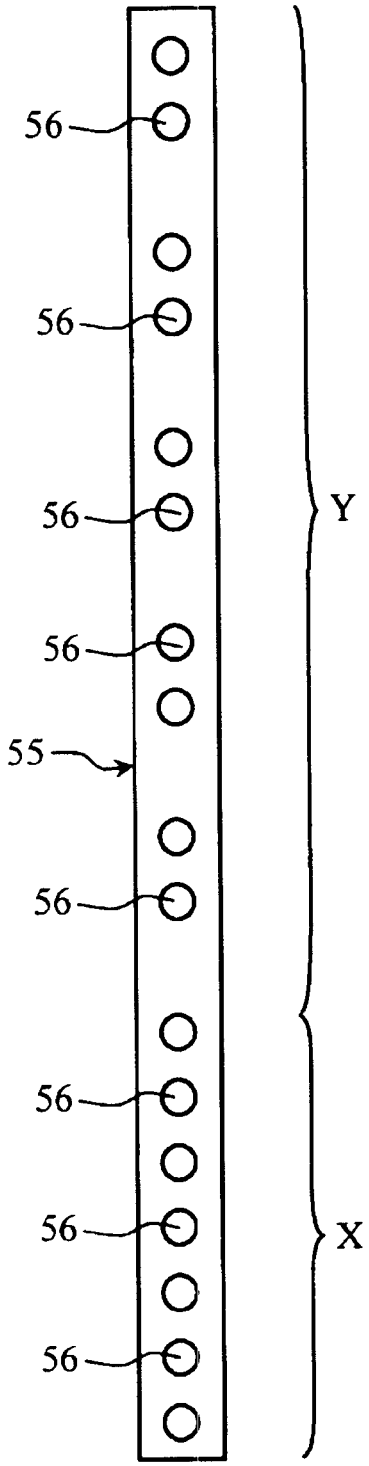
FIG. 6 is a front view illustrating an example of gas inlet tubes of the glow discharge decomposition device shown in FIGS. 4 and 5.

In using such glow discharge decomposition device 5, by arranging the gas inlet ports 56 of each of the gas inlet tubes 55 at intervals changing gradually or stepwise, the thickness of the photoconductive layer 28 may be changed gradually or stepwise in the axial direction. For example, as shown in FIG. 6, in an area X corresponding to the area of the photoconductive layer 28 including the first end 22A, the gas inlet ports 56 are arranged at intervals shorter than those in an area Y corresponding to the area including the second end 22B. In this way, the thickness at the first end 22A can be larger than at the second end 22B. The ratio of intervals in the area X to intervals in the area Y may be set according to the thickness of the photoconductive layer 28 at the first and second ends 22A, 22B, or to the ratio of thickness of the photoconductive layer 28 at the end 22A to the one at the end 22B, and may be set to not less than 1.06 to 1 and not more than 2.25 to 1, for example. In FIG. 4, the gas inlet ports 56 of the gas inlet tubes 55 are arranged at shorter intervals in the bottom area but not limited to this, and may be arranged at short intervals in the top area, for example.

Further, by providing temperature distribution in the axial direction of the cylindrical body housing the heater 54, the thickness of the photoconductive layer 28 can be larger at the first end 22A than at the second end 22B. Specifically, by setting the temperature of the cylindrical body 20 higher in the area corresponding to the first end 22A than the temperature in the area corresponding to the second end 22B, the thickness at the first end 22A can be larger than at the second end 22B.

The surface layer 29 shown in FIG. 3 for protecting the photoconductive layer 28 from friction and wear is laminated on the surface of the photoconductive layer 28. The surface layer 29 is formed of an inorganic material represented by a-Si material such as a-SIC, and has a thickness of not less than 0.2 μm and not more than 1.5 μm. By making the surface layer 29 to have a thickness of not less than 0.2 μm, flaw in image and variation in density due to wear can be prevented, and by making the surface layer 29 to have a thickness of not more than 1.5 μm, initial characterization (such as defective image due to residual potential) can be improved. Preferably, the thickness of the surface layer 29 may be not less than 0.5 μm and not more than 1.0 μm.

In the surface layer 29, the thickness at the first end 22A at the side of the power transmitting flange 30E is larger than the thickness at the second end 22B at the side of the bearing flange 31. The ratio of thickness of the surface layer 29 at the first end 22A to the one at the second end 22B may be set to not less than 1.03 to 1 and not more than 1.25 to 1. The difference between the thickness at the first end 22A and at the second end 22B is set to not less than 0.03 μm to not more than 0.2 lμm, preferably not less than 0.09 μm and not more than 0.14 μm.

The thickness of the surface layer 29 at the first and second ends 22A, 22B is defined similarly to the thickness of the photoconductive layer 28, and is similarly calculated by optical interferometry. However, wavelength of light used for measuring the thickness of the surface layer 29 is at not less than 400 nm and not more than 700 nm.

In the surface layer 29, the dynamic indentation hardness at the first end 22A at the side of the power transmitting flange 30E is higher than the dynamic indentation hardness at the second end 22B at the side of the bearing flange 31. The dynamic indentation hardness of the surface layer 29 gradually becomes higher as proceeding from the second end 22B toward the first end 22A, or becomes higher stepwise as proceeding from the second end 22B toward the first end 22A.

Such surface layer 29 is preferably formed of a-SiC:H in which a-SiC contains hydrogen. Proportion of elements in a-SiC:H can be expressed in a composition formula a-Si.sub.1-XC.sub.X:H, in which the value of X is not less than 0.55 and less than 0.93, for example. By setting the value X to not less than 0.55, a proper hardness for the surface layer 29 can be obtained, and endurance of the surface layer 29 and thus of the electrophotographic photosensitive member 2 can be reliably maintained. By setting the value X to less than 0.93, a proper hardness for the surface layer 29 can be also obtained. Preferably, the value X is set to not less than 0.6 and not more than 0.7. In forming the surface layer 29 using a-SiC:H, H content may be set to about not less than one atom % and not more than 70 atom %. When the H content is set within the above range, Si—H binding is lower than Si—C binding, electrical charge trap generated by light irradiation on the surface of the surface layer 29 can be controlled, thereby suitably preventing residual potential. According to the knowledge of the inventors, by setting the H content to not more than about 45 atom %, more favorable results can be obtained.

Such surface layer 29 of a-SiC:H can be formed, similarly to the formation of the photoconductive layer 28 using a-Si material, utilizing the glow discharge decomposition device 5 shown in FIGS. 4 and 5. In this case, to make the thickness of the surface layer 29 at the first end 22A to be larger than at the second end 22B, material gas may include Si-containing gas such as silane gas ($SiH_4$) C-containing gas such as methane gas ($CH_4$), and if necessary, diluent gas such as $H_2$ gas, and the gas inlet tubes 55 illustrated in FIG. 6 may be used similarly to the formation of the photoconductive layer 28. Further, the thickness of the surface layer 29 at the first end 22A can also be made larger than at the second end 22B, by setting the temperature of the cylindrical body 20 to be higher at an area corresponding to the first end 22A than at an area corresponding to the second end 22B.

In using the gas inlet tubes 55 shown in FIG. 6 to make the thickness at the first end 22A larger than the thickness at the second end 22B, conditions are set as follows, for example: The gas ratio of CH4 to $SiH_4$ is not less than 10 and not more than 300; The dilution rate using H2 gas is not less than 0% and not more than 50%; The gas pressure for film forming is about not less than 0.15 Torr and not more than 0.65 Torr; The high-frequency electricity is about not less than 100 W and not more than 350 W per one cylindrical body 20; The temperature of the cylindrical body 20 is not less than 200° and not more than 300°; The high-frequency electricity is applied under frequency of 13.56 MHz, or under frequency of 13.56 MHz with pulse-modulation at 1 kHz.

Figure 7:
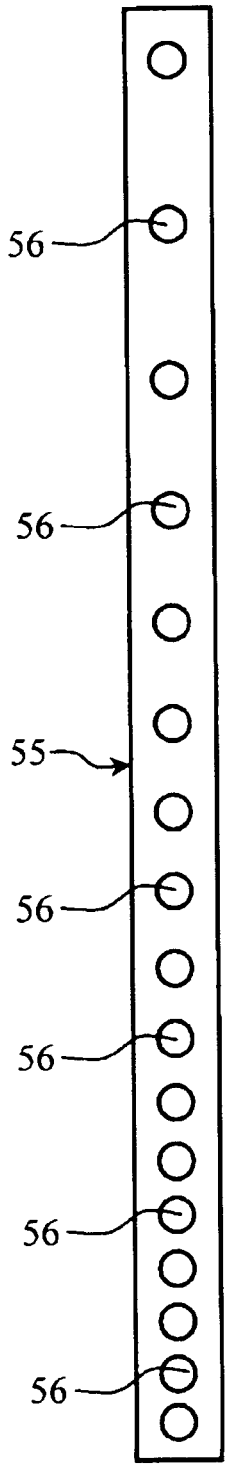
FIG. 7 is a front view illustrating another example of gas inlet tubes of the glow discharge decomposition device shown in FIGS. 4 and 5.

As shown in FIG. 7, each of the gas inlet tubes 55 for forming the photoconductive layer 28 and the surface layer 29 may include a plurality of gas inlet ports 56 arranged at shorter intervals as proceeding toward an end (at the side of the inside low portion 24 of the cylindrical body 20).

The rotation mechanism 3 of the image forming apparatus 1 shown in FIG. 2 serves to rotate the electrophotographic photosensitive member 2, and includes a rotation system 30 in addition to the bearing flange 31.

The rotation system 30 transmits the rotation energy of a motor 30A to the electrophotographic photosensitive member 2, for rotating the electrophotographic photosensitive member 2. The rotation system 30 includes drive gears 30B, 30C, 30D, in addition to the motor 30A and the power transmission flange 30E.

The drive gears 30B, 30C, 30D include various sizes of gears for transmitting the rotation energy of the motor 30A to the power transmission flange 30E. The rotation speed of the electrophotographic photosensitive member 2 rotated via the drive gears 30B, 30C, 30D is a constant speed of 320 mm/sec, for example, as a circumferential velocity at the surface.

The power transmission flange 30E serves to transmit the rotation energy from the drive gears 30B, 30C, 30D to the electrophotographic photosensitive member 2. The power transmission flange 30B includes a fitting portion 30Ea to be fitted into the inside low portion 24 of the cylindrical body 20, and a gear portion 30Eb to engage with the gear 30D. The fitting portion 30Ea has an outer dimension substantially equal to the inner dimension of the inside low portion 24, and is non-rotatably fixed to the cylindrical body 20.

The bearing flange 31 rotatably supports the electrophotographic photosensitive member 2. The bearing flange 31 is fitted into the inside low portion 25 of the cylindrical body 20 with a gap 6 (so-called "play").

The rotation system 30 is not limited to the one including the drive gears 30B, 30C, 30D, but if capable of providing a predetermined rotation energy to the electrophotographic photosensitive member 2, may have other structure, such as a structure providing the rotation energy by a rotation belt, a wire, or a chain.

The electrification roller 41 shown in FIG. 1 uniformly charges the surface of the electrophotographic photosensitive member 2, positively and negatively at about a range of not less than 200V and not more than 1000V, according to the type of the photoconductive layer 28 of the electrophotographic photosensitive member 2. The electrification roller 41 is arranged in pressing contact with the electrophotographic photosensitive member 2, and is made by coating a cored bar with conductive rubber and PVDF (polyvinylidene fluoride).

The exposure mechanism 42 serves to form an electrostatic latent image on the electrophotographic photosensitive member 2, and is capable of emitting light of a predetermined wavelength (not less than 650 nm and not more than 780 nm, for example). The exposure mechanism 42 forms an electrostatic latent image which is an electric potential contrast by emitting light on the surface of the electrophotographic photosensitive member 2 according to an image signal, and lowering the electrical potential at the emitted portion. An example of the exposure mechanism 42 includes a LED head in which LED elements capable of emitting light at a wavelength of e.g. about 680 nm are arranged at 600 dpi.

Of course, the exposure mechanism 42 may be capable of emitting laser light. By replacing the exposure mechanism 42 having a LED head with an optical system using e.g. laser light or a polygon mirror or with an optical system using e.g. a lens or a mirror through which light reflected at paper is transmitted, the image forming apparatus may have a function of a copying apparatus.

The development mechanism 43 forms a toner image by developing the electrostatic latent image formed on the electrophotographic photosensitive member 2. The development mechanism 43 includes a magnetic roller 43A for magnetically holding developer (toner) and a wheel (not shown) or a so-called skid for adjusting a distance (gap) from the electrophotographic photosensitive member 2.

The developer serves to develop a toner image formed on the surface of the electrophotographic photosensitive member 2, and is frictionally charged at the development mechanism 43. The developer may be a binary developer of magnetic carrier and insulating toner, or a one-component developer of magnetic toner.

The magnetic roller 43A serves to transfer the developer to the surface (developing area) of the electrophotographic photosensitive member 2.

In the development mechanism 43, the toner frictionally charged by the magnetic roller 43A is transferred in a form of magnetic brush with bristles each having a predetermined length. On the developing area of the electrophotographic photosensitive member 2, the toner is caused to stick to the surface of the electrophotographic photosensitive member 2 by electrostatic attraction between the toner and the electrostatic latent image, and becomes visible. When the toner image is formed by regular developing, the toner image is charged in the reverse polarity of the polarity of the surface of the electrophotographic photosensitive member 2. On the other hand, when the toner image is formed by reverse developing, the toner image is charged in the same polarity as the polarity of the surface of the electrophotographic photosensitive member 2.

Though the development mechanism 43 utilizes a dry developing method, a wet developing method using liquid developer may be utilized.

The transfer mechanism 44 transfers the toner image on the electrophotographic photosensitive member 2 onto a recording medium P supplied to a transfer area between the electrophotographic photosensitive member 2 and the transfer mechanism 44. The transfer mechanism 44 includes a transfer charger 44A and a separation charger 44B. In the transfer mechanism 44, the rear side (non-recording surface) of the recording medium P is charged in the reverse polarity of the toner image by the transfer charger 44A, and by the electrostatic attraction between this electrification charge and the toner image, the toner image is transferred on the recording medium P. Further, in the transfer mechanism 44, simultaneously with the transfer of the toner image, the rear side of the recording medium P is charged in alternating polarity by the separation charger 44B, so that the recording medium P is quickly separated from the surface of the electrophotographic photosensitive member 2.

As the transfer mechanism 44, a transfer roller driven with the rotation of the electrophotographic photosensitive member 2, and being spaced from the electrophotographic photosensitive member 2 by a minute gap (generally, not more than 0.5 mm) may be used. Such transfer roller applies a transfer voltage to the recording medium P, using e.g. direct-current power source, for attracting the toner image on the electrophotographic photosensitive member 2 onto the recording medium P. In using the transfer roller, a separation member such as the separation charger 44B is omitted.

The fixing mechanism 45 serves to fix a toner image, which is transferred on the recording medium P, onto the recording medium P, and includes a pair of fixing rollers 45A, 45B. Each of the fixing rollers 45A, 45B is, for example, a metal roller coated by Teflon (registered trademark). In the fixing mechanism 45, the recording medium P passes through between the fixing rollers 45A, 45B, so that the toner image is fixed on the recording medium P by heat or pressure.

The cleaning mechanism 46 shown in FIGS. 1 and 2 serves to remove the toner remaining on the surface of the electrophotographic photosensitive member 2, and includes a cleaning blade 46A.

The cleaning blade 46A serves to scrape the remaining toner off the surface of the surface layer 29 of the electrophotographic photosensitive member 2. The cleaning blade 46A is supported by a case 46C via urging means such as springs 46B, so that its tip end presses the latent image forming area 22 of the electrophotographic photosensitive member 2. The cleaning blade 46A is made of a rubber material mainly containing polyurethane resin, for example, and has a thickness of not less than 1.0 mm and not more than 1.2 mm at its tip portion in contact with the surface layer 29 (see FIG. 2), a linear pressure of 14 gf/cm (generally not less than 5 gf/cm and not more than 30 gf/cm), and a JIS hardness of 74 degrees (preferably not less than 67 degrees and not more than 84 degrees)

The discharging mechanism 47 removes surface charge on the electrophotographic photosensitive member 2. The discharging mechanism 47 irradiates the whole surface (the surface layer 29) of the electrophotographic photosensitive member 2 by a light source such as a LED, and removes the surface charge (remaining electrostatic latent image) of the electrophotographic photosensitive member 2.

In the electrophotographic photosensitive member 2 of the image forming apparatus 1, the power transmitting flange 30E is firmly fixed to the inside low portion 24 at the side of the first end 22A, while the bearing flange 31 is attached to the inside low portion 25 at the side of the second end 22B with the gap 6. Thus, in the photosensitive layer 21, the pressing force applied to the first end 22A is larger than the pressing force applied to the second end 22B. Here, the thickness of the photoconductive layer 28 and the surface layer 29, or the photosensitive layer 21 is made to be larger at the first end 22A than at the second end 22B.

With such arrangement, even if a foreign object such as dust is caught between the electrophotographic photosensitive member 2 and the pressing members such as the cleaning blade 46A and the electrification roller 41 pressing the electrophotographic photosensitive member 2, a crack is unlikely to be caused. Even if a crack is caused, as the thickness of the photosensitive layer 21 (the photoconductive layer 28 and the surface layer 29) is larger at the first end 22A than at the second end 22B, the crack caused at the first end 22A is prevented from extending to the photoconductive layer 28 and to the cylindrical body 20. In this way, the arrangement prevents damage of the photosensitive layer 28, electrical short circuit between the photoconductive layer 28 and the surface layer 29, and charge leakage to the cylindrical body 20. As a result, the photosensitive layer 21 (photoconductive layer 28) is unlikely to be functionally broken, and thus the image forming apparatus 1 is prevented from forming a defective image and stands long use.

Further, in the electrophotographic photosensitive member 2, the dynamic indentation hardness of the photosensitive layer 21 is larger at the first end 22A than at the second end 22B. Thus, even if a foreign object is caught between the electrophotographic photosensitive member 2 and the pressing members such as the cleaning blade 46A and the electrification roller 41, as the photosensitive layer 21 has a relatively high hardness at the first end 22A, a crack is unlikely to be caused. Therefore, in the electrophotographic photosensitive member 2, the photoconductive layer 28 is unlikely to be damaged, and thus the photoconductive layer 28 can be prevented from being functionally broken. As a result, the image forming apparatus 1 incorporating the electrophotographic photosensitive member 2 is prevented from forming a defective image and stands long use.

The present invention is not limited to the above-described embodiment, and may be variously modified. For example, the present invention may be applied in any image forming apparatus if a pressing member of the image forming apparatus applies larger pressing force to the electrophotographic photosensitive member 2 at the first end 22A than at the second end 22B. For example, the electrification roller 41 may be provided with springs right above the ends in the axial direction, and the pressing force of one of these springs may be stronger than the other one. Even in such a case, by applying the present invention to the electrophotographic photosensitive member 2, the photosensitive layer 21 and especially the photoconductive layer 28 can be prevented from being functionally broken at the first end 22A.

Figure 8A:
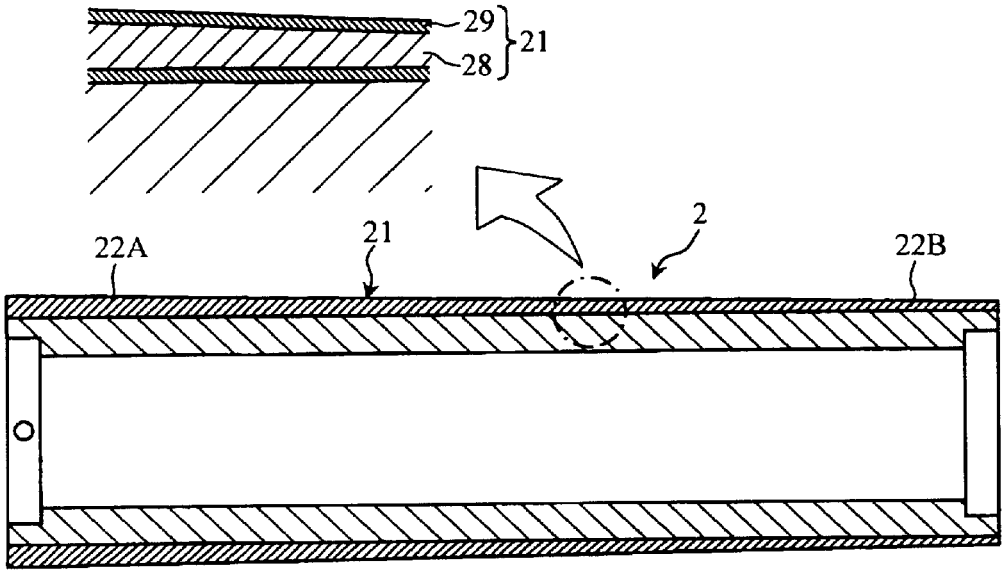
FIGS. 8A and 8B are enlarged sectional views illustrating another example of the electrophotographic photosensitive member according to the present invention.
Figure 8B:
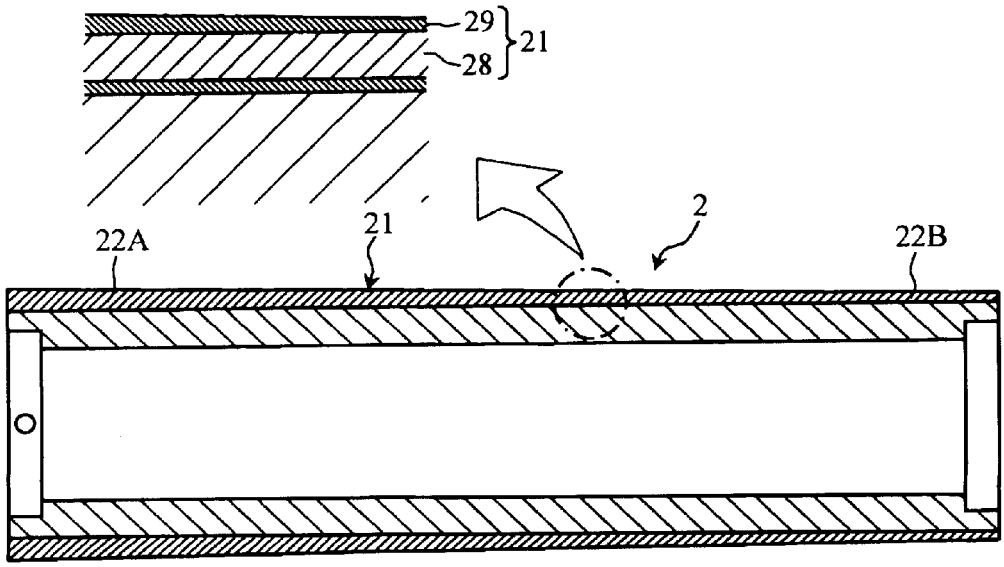

In the present embodiment, both of the photoconductive layer 28 and the surface layer 29 have thickness larger at the first end 22A than at the second end 22B, however, as shown in FIGS. 8A, 8B, only one of the photoconductive layer 28 and the surface layer 29 may have thickness larger at the first end 22A than at the second end 22B.

Figure 9:
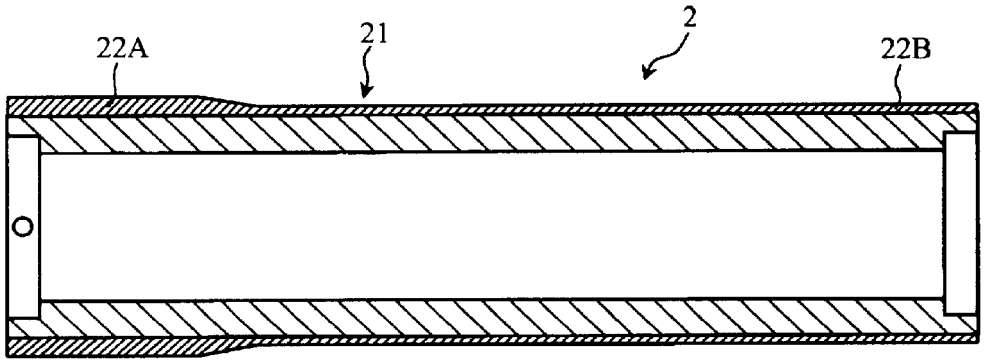
FIG. 9 is a sectional view illustrating another example of the electrophotographic photosensitive member according to the present invention.

Further, as shown in FIG. 9, the photosensitive layer 21 is not limited to the one whose thickness gradually becomes larger, however, the thickness may become larger stepwise as proceeding from the first end 22A toward the second end 22B. Such photosensitive layer 21 can be formed by making at least one of the photoconductive layer or the surface layer to have a thickness becoming larger stepwise as proceeding from the first end 22A toward the second end 22B. In the example shown in FIG. 9, only one step is formed between the first end 22A and the second 22B, however, more than two steps may be formed.

Figure 10:
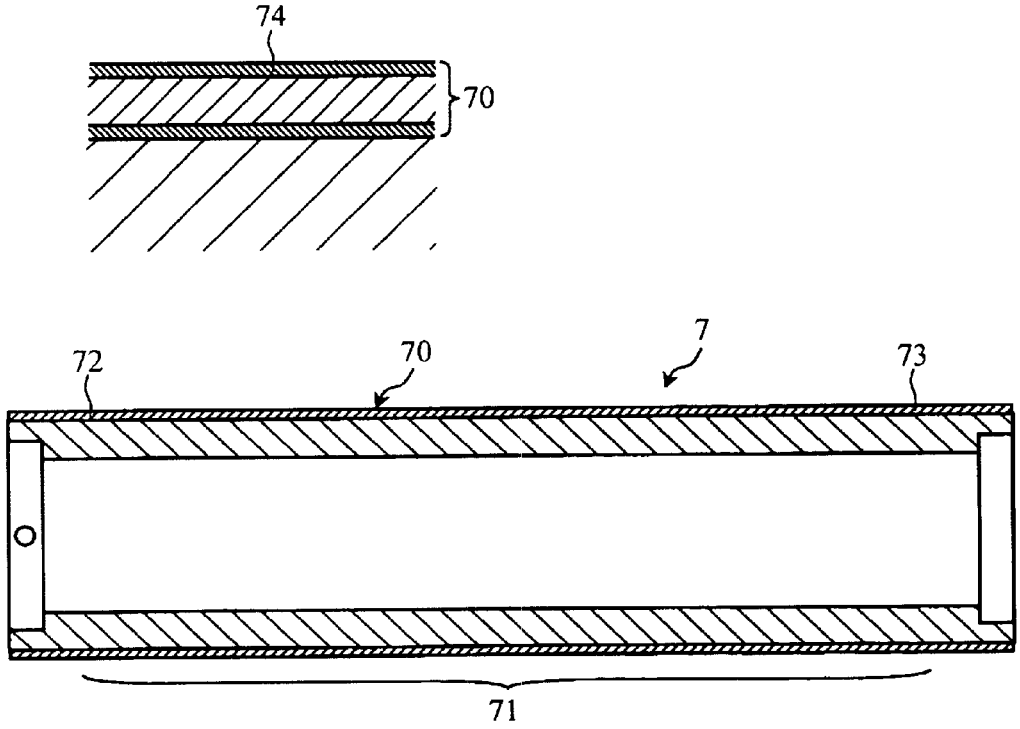
FIG. 10 is a sectional view and an enlarged view illustrating another example of the electrophotographic photosensitive member according to the present invention.

Still further, as shown in FIG. 10, an electrophotographic photosensitive member 7 may be used, which include a photosensitive layer 70 having a thickness constant at a first end 72 and a second end 73 of a latent image forming area 71. The photosensitive layer 70 has dynamic indentation hardness larger at the first end 72 than at the second end 73. When forming the surface layer 74 by a material mainly containing a-Sic, carbon content at the first end 72 and at the second end 73 is controlled, so that the dynamic indentation hardness of the photosensitive layer 70 is larger at the first end 72 than at the second end 73. Specifically, when comparing the ratio of Si:C in the surface layer 74 at the first end 72 to that at the second end 73, it suffices if the carbon content, which is within a range of not less than 20% to not more than 70%, is higher at the first end 72 than at the second end 73.

EXAMPLES

Example 1

In the present example, influence on the image property was studied, when changing the thickness at the ends of the surface layer of the electrophotographic photosensitive member.

(Manufacture of Electrophotographic Photosensitive Member)

In manufacturing the electrophotographic photosensitive member, a cylindrical body was prepared by making a drawn tube of aluminum alloy with an outer diameter of 84 mm and a length of 360 mm, and then performing mirror finishing on the outer circumference of the drawn tube before cleaning. Next, the prepared cylindrical body 20 was incorporated in the glow discharge decomposition device 5 shown in FIGS. 4 and 5, and an anti-charge injection layer 27 and a photoconductive layer 28 were laminated on the surface of the cylindrical body 20 using a gas inlet tube 55' shown in FIG. 11 under film forming conditions shown in Table 1. Thereafter, a surface layer 29 was formed on the photoconductive layer 28 using the gas inlet tube 55 shown in FIG. 6 under film forming conditions shown in Table 2, thereby manufacturing an electrophotographic photosensitive member A according to the present invention (hereinafter referred to as "photosensitive member A"). Table 2 shows film forming conditions at a boundary surface between the surface layer 29 and the photoconductive layer 28 as well as film forming conditions at a free surface of the surface layer 29.

In the gas inlet tube 55 shown in FIG. 6, a plurality of the gas inlet ports 56 were arranged at short intervals in the area X (at the side of the inside low portion 24 to which the power transmission flange of the cylindrical body 20 is fixed), while arranged at long intervals in the area Y (at the side of the inside low portion 25 to which the bearing flange 31 of the cylindrical body 20 is fixed).

As a comparative example, an electrophotographic photosensitive member B (hereinafter referred to as "photosensitive member B") was manufactured, by forming an anti-charge injection layer 27, a photoconductive layer 28, and a surface layer 29 laminated to each other using only the gas inlet tube 55T shown in FIG. 11 under the film forming conditions shown in Tables 1 and 2.

Figure 11:
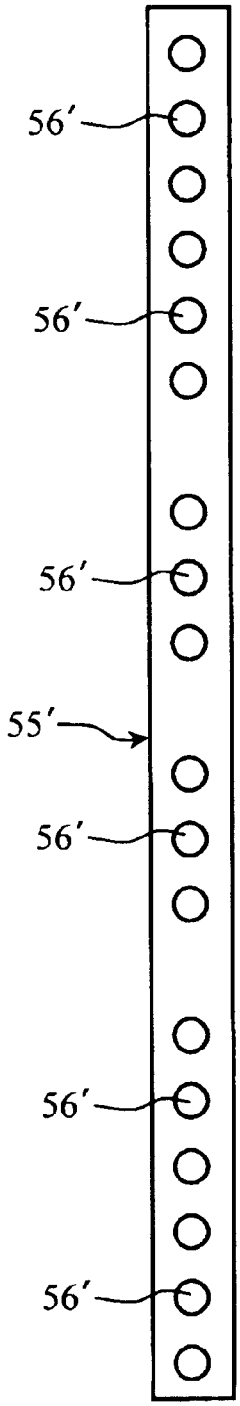
FIG. 11 is a front view illustrating a gas tube of a glow discharge decomposition device for manufacturing a conventional electrophotographic photosensitive member (as a comparative example).
Figure 12:
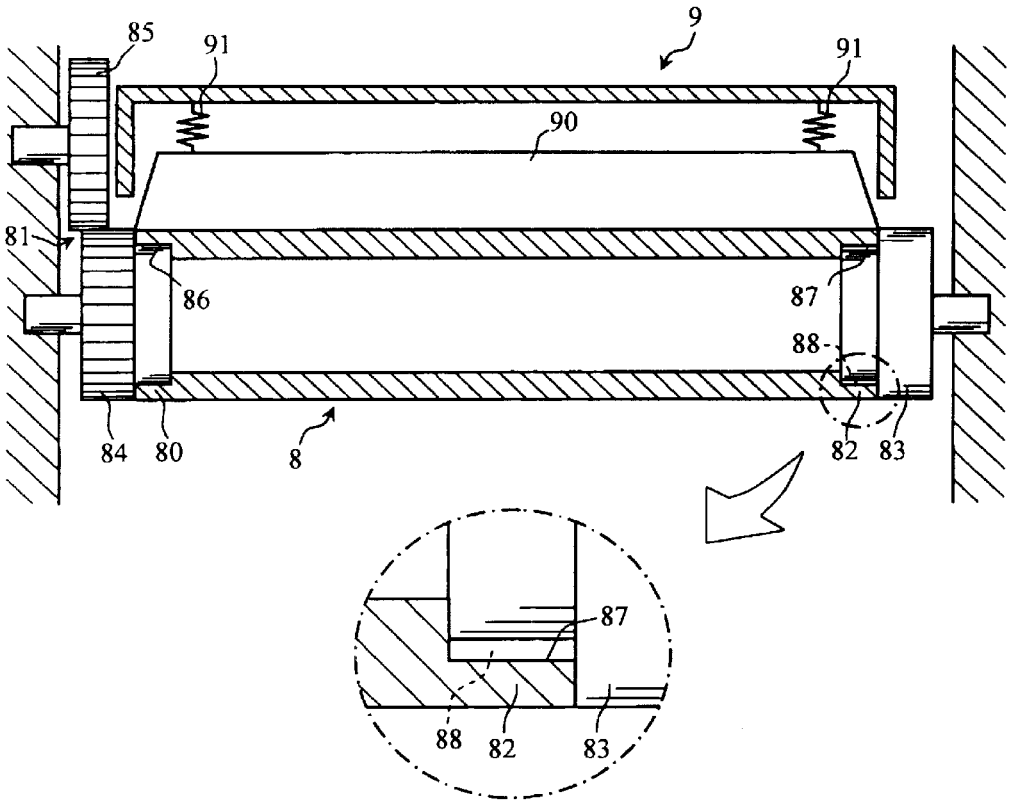
FIG.12 PRIOR ART
FIG. 12 is a sectional view illustrating a conventional electrophotographic photosensitive member, corresponding to FIG. 2.

In the gas inlet tube 55, shown in FIG. 11, a plurality of gas inlet ports 56' were arranged at substantially uniform intervals at the side of the inside low portion 24 to which the power transmission flange 30E is fixed, and at the side of the inside low portion 25 to which the bearing flange 31 is fixed.

TABLE 1

| | | Layer | |
|---|---|---|---|
| | | Anti-charge Injection Layer | Photo-conductive Layer |
| Gas Flow | $SiH_4$ (sccm) | 133 | 300 |
| Amount | $B_2H_6$* | 0.12% | 2.0 ppm |
| | NO* | 10.40% | — |
| Gas Pressure (Pa) | | 60 | 70.5 |
| Board Temperature (° C.) | | 280 | 280 |
| RF Electric Power (W) | | 146 | 300 |
| Film Forming Time (Hr) | | 1 | 5 |
| Central Film Thickness (μm) | | 2.5 | 30 |

*proportion to the amount of SiH4

TABLE 2

| | | Layer Surface Layer | |
|---|---|---|---|
| | | Boundary Surface | Free Surface |
| Gas Flow Amount | $SiH_4$ (sccm) | 24.7 | 6.8 |
| | $B_2H_6$ (sccm) | 456 | 468 |
| | $H_2$ (sccm) | 650 | 650 |
| Gas Pressure (Pa) | | 86.6 | 86.6 |
| Board Temperature (° C.) | | 280 | 280 |
| RF Electric Power (W) | | 150 | 150 |
| Film Forming Time (Hr) | | 1 | 0.5 |
| Central Film Thickness (μm) | | 0.85 | |

(Measuring Thickness of Surface Layer)

The thickness of the surface layers were measured at end portions of the photosensitive members A, B (portions apart from the respective ends of the electrophotographic photosensitive members A, B by 40 mm in the axial direction), utilizing an optical thickness measuring apparatus (Model (Number): MC-850A manufactured by Otsuka Electronics Co., Ltd). Table 3 shows the measurement results of thickness of the surface layers. The thickness of each of the surface layers was measured at any five points along the circumference of each of the photosensitive members, and the average value is shown in Table 3.

TABLE 3

| | Photosensitive Member A | | Photosensitive Member B | |
|---|---|---|---|---|
| | Power Transmission Side | Bearing Side | Power Transmission Side | Bearing Side |
| Film Thickness of SiC Surface Layer (μm) | 0.97 (1.17) | 0.83 | 0.84 (1.00) | 0.84 |

The numbers in the parentheses indicate ratio of film thickness at the power transmission side to the thickness at the bearing side.

As can be seen from Table 3, in the photosensitive member A, thickness of the surface layer was larger at the side of the power transmission flange than at the side of the bearing flange, while in the photosensitive member B, thickness of the surface layer was substantially the same at the side of the power transmission flange and at the side of the bearing flange.

(Evaluation of Image Property)

The photosensitive members A, B were incorporated in an electrophotographic printer (Model: KM-6030 manufactured by Kyocera Mita Corporation) for printing 300 thousand copies. The image property was evaluated by visually checking flaws and variation in density of printed images. The checking of flaws and variation in density of printed images was performed at the beginning of printing and after printing five thousand copies, ten thousand copies, 50 thousand copies, 100 thousand copies, and 300 thousand copies.

Table 4 shows the evaluation results of flaws and variation in density of printed images. In Table 4, the evaluation results were respectively indicated as "○" when neither flaw nor variation in density was found, as "Δ" when a slight flaw or variation in density which may cause no practical problem was found, and as "x" when any flaw or variation in density which may cause a practical problem was found.

TABLE 4

| | | Photosensitive Member | | | |
|---|---|---|---|---|---|
| | | Photosensitive Member A | | Photosensitive Member B | |
| | | Evaluation Item | | | |
| | | Flaw | Variation in Density | Flaw | Variation in Density |
| Number of Printing | Beginning | ○ | ○ | ○ | ○ |
| | 5,000 | ○ | ○ | ○ | ○ |
| | 10,000 | ○ | ○ | ○ | ○ |
| | 50,000 | ○ | ○ | ○ | ○ |
| | 100,000 | ○ | ○ | x (Power Transmission Side) | ○ |
| | 300,000 | ○ | ○ | x (Power Transmission Side) | ○ |

As can be seen from Table 4, with the photosensitive member A in which the thickness of the surface layer was larger at the side of the power transmission flange than at the side of the bearing flange, neither flaw nor variation in density was found, and even after printing 300 thousand copies, images of good quality were obtained.

On the other hand, with the photosensitive member B in which the thickness of the surface layer was the same at the side of the power transmission flange and at the side of the bearing flange, after printing about 50 thousand copies, flaws were found at one end (at the side of the power transmission flange), and after printing not less than one million copies, flaws which may cause a practical problem were found.

The results show that the electrophotographic photosensitive member in which the surface layer has a thickness larger at the side of the power transmission flange than at the side of the bearing flange is less likely to have a flaw in printed images, thereby having enhanced image property.

Example 2

In the present example, influence on the image property was studied, when changing the proportion of thickness of the surface layer at the side of the power transmission flange to the thickness at the side of the bearing flange.

(Manufacture of Electrophotographic Photosensitive Member)

Electrophotographic photosensitive members C, D, E, F were manufactured by the same method as Example 1. specifically, an anti-charge injection layer and a photoconductive layer were laminated on the surface of the cylindrical body 20 using the gas inlet tube 55' shown in FIG. 11 under film forming conditions shown in Table 1. Thereafter, a surface layer was formed on the photoconductive layer using the gas inlet tube 55 shown in FIG. 6 under film forming conditions shown in Table 2.

The gas inlet tubes 55 for forming the surface layers had respective gas inlet ports arranged differently in the area X (see FIG. 6), so that the surface layers of the electrophotographic photosensitive members C, D, E, F had different thickness at the side of the power transmission flange.

(Measuring Thickness of Surface Layer)

The thickness of the surface layers were measured at the same portions and by the same method as Example 1. Table 5 shows the measurement results of thickness of the surface layers, together with the thickness of the photosensitive members A, B measured in Example 1.

(Evaluation of Image Property)

The image property was evaluated by the same method as Example 1, after printing 300 thousand copies. The evaluation results are shown in Table 5 together with the results of the photosensitive members A, B checked in Example 1.

TABLE 5

| | Film Thickness of SiC Surface Layer (μm) | | | |
|---|---|---|---|---|
| | Power | | Image Property | |
| Photosensitive Member | Transmission Side | Bearing Side | Flaw | Variation in Density |
| Photosensitive Member B | 0.84 (1.00) | 0.84 | x | ○ |
| C | 0.89 (1.03) | 0.86 | Δ | ○ |
| D | 0.94 (1.11) | 0.85 | ○ | ○ |
| A | 0.97 (1.17) | 0.83 | ○ | ○ |
| E | 1.05 (1.25) | 0.84 | ○ | Δ |
| F | 1.07 (1.27) | 0.84 | ○ | x |

As can be seen from Table 5, in the photosensitive members C, D, A, E in which a proportion of thickness of the surface layers at the side of the power transmission flange to the thickness at the side of the bearing flange was not less than 1.03 and not more than 1.25, neither flaw nor variation in density which may cause a practical problem was found. In each of the photosensitive members C, D, A, E, difference between the thickness of the surface layer at the side of the power transmission flange and the thickness at the side of the bearing flange was not less than 0.03 μm and not more than 0.21 μm.

On the other hand, in the photosensitive member F in which the thickness of the surface layer at the side of the power transmission flange was 1.27 times the thickness at the side of the bearing flange, variation in density in the axial direction of the member was found in the beginning of printing. In the photosensitive member B in which the thickness of the surface layer was the same at the side of the power transmission flange and at the side of the bearing flange, after printing 300 thousand copies, flaws which may cause a practical problem were found in the printed images at the side of the power transmission flange of the surface layer.

Thus, in the electrophotographic photosensitive member, it is preferable that thickness of the surface layer at the side of the power transmission flange is set to not less than 1.03 and not more than 1.25 times larger the thickness at the side of the bearing flange, and that the difference between the thickness of the surface layer at the side of the power transmission flange and the thickness at the side of the bearing flange is set to not less than 0.03 μm and not more than 0.21 μm.

Example 3

In the present example, influence on the image property was studied, when changing the thickness at the ends of the photoconductive layer of the electrophotographic photosensitive member.

(Manufacture of Electrophotographic Photosensitive Member)

An electrophotographic photosensitive member G (hereinafter referred to as "photosensitive member G") was manufactured by the same method as Example 1. Specifically, an anti-charge injection layer was formed on the surface of the cylindrical body 20 using the gas inlet tube 55' shown in FIG. 11 under film forming conditions shown in Table 1. Next, a photoconductive layer was laminated on the anti-charge injection layer using the gas inlet tube 55 shown in FIG. 6 under film forming conditions shown in Table 1. Thereafter, a surface layer was laminated on the photoconductive layer using the gas inlet tube 55' again, under film forming conditions shown in Table 2.

In the gas inlet tube 55 shown in FIG. 6, the gas inlet ports 56 were arranged at short intervals in the area X (at the side of the inside low portion 24 to which the power transmission flange of the cylindrical body 20 is fixed), while arranged at long intervals in the area Y (at the side of the inside low portion 25 to which the bearing flange of the cylindrical body 20 is fixed).

As a comparative example, an electrophotographic photosensitive member H (hereinafter referred to as "photosensitive member H") was manufactured, by forming an anti-charge injection layer, a photoconductive layer, and a surface layer laminated to each other using only the gas inlet tube 55, shown in FIG. 11 under the film forming conditions shown in Tables 1 and 2. In the gas inlet tube 55' shown in FIG. 11, a plurality of gas inlet ports 56' were arranged at substantially uniform intervals at the side of the inside low portion 24 to which the power transmission flange is fixed, and at the side of the inside low portion 25 to which the bearing flange is fixed.

(Measuring Thickness of Photoconductive Layer)

The thickness of the photoconductive layers was measured at end portions of the photosensitive members G, H (portions apart from the respective ends of the photosensitive members G, H by 35 mm in the axial direction), utilizing an optical thickness measuring apparatus (Model (Number): MC-850A manufactured by Otsuka Electronics Co., Ltd). Table 6 shows the measurement results of thickness of the photoconductive layers. The thickness of each of the photoconductive layers was measured at any five points along the circumference of each of the photosensitive members, and the average value is shown in Table 6.

TABLE 6

| | Photosensitive Member G | | Photosensitive Member H | |
|---|---|---|---|---|
| | Power Transmission Side | Bearing Side | Power Transmission Side | Bearing Side |
| Film Thickness of SiC Photoconductive Layer (μm) | 33.0 (1.12) | 29.5 | 29.5 (1.00) | 29.5 |

The numbers in the parentheses indicate proportion of film thickness at the power transmission side to the thickness at the bearing side.

(Evaluation of Image Property)

The image property was evaluated by the same method as Example 1, after printing 300 thousand copies. The evaluation results are shown in Table 7. The evaluation standard of image property in Table 7 is the same as Example 1.

TABLE 7

| | | Photosensitive Member | | | |
|---|---|---|---|---|---|
| | | Photosensitive Member G | | Photosensitive Member H | |
| | | Evaluation Item | | | |
| | | Flaw | Variation in Density | Flaw | Variation in Density |
| Number of Printing | Beginning | ○ | ○ | ○ | ○ |
| | 5,000 | ○ | ○ | ○ | ○ |
| | 10,000 | ○ | ○ | ○ | ○ |
| | 50,000 | ○ | ○ | Δ | ○ |
| | 100,000 | ○ | ○ | x (Power Transmission Side) | ○ |
| | 300,000 | ○ | ○ | x (Power Transmission Side) | ○ |

As can be seen from Table 7, with the photosensitive member G in which the thickness of the photoconductive layer was larger at the side of the power transmission flange than at the side of the bearing flange, neither flaw nor variation in density was found, and even after printing 300 thousand copies, images of good quality were obtained.

On the other hand, with the photosensitive member H in which the thickness of the photoconductive layer was the same at the side of the power transmission flange and at the side of the bearing flange, after printing about 50 thousand copies, flaws were found at the side of the power transmission flange, and after printing not less than one million copies, flaws which may cause a practical problem were found.

The results show that the electrophotographic photosensitive member in which the photoconductive layer has a thickness larger at the side of the power transmission flange than at the side of the bearing flange is less likely to have a flaw in printed images, thereby having enhanced image property.

Example 4

In the present example, influence on the image property was studied, when changing the proportion of thickness of the photoconductive layer at the side of the power transmission flange to the thickness at the side of the bearing flange.

(Manufacture of Electrophotographic Photosensitive Member)

Electrophotographic photosensitive members I, J, K, L were manufactured by the same method as Example 3. Specifically, an anti-charge injection layer was formed on the surface of the cylindrical body 20 using the gas inlet tube 55, shown in FIG. 11 under film forming conditions shown in Table 1. Next, a photoconductive layer was laminated on the anti-charge injection layer using the gas inlet tube 55 shown in FIG. 6 under film forming conditions shown in Table 1. Thereafter, a surface layer was laminated on the photoconductive layer using the gas inlet tube 55' again, under film forming conditions shown in Table 2. The gas inlet tubes had respective gas inlet ports arranged differently in the area X (see FIG. 6), so that the photoconductive layers of the respective electrophotographic photosensitive members I, J, K, L had different thickness at the side of the power transmission flange.

(Measurement of Measuring Thickness of Photoconductive Layer)

The thickness of the photoconductive layers was measured at the same portions and by the same method as Example 3. Table 8 shows the measurement results of thickness of the photoconductive layers, together with the thickness of the photosensitive members G, H measured in Example 3.

(Evaluation of Image Property)

The image property was evaluated by the same method as Example 1, after printing 300 thousand copies. The evaluation results are shown in Table 8 together with the results of the photosensitive members C, H checked in Example 3.

TABLE 8

| | Film Thickness of SiC Surface Layer (μm) | | | |
|---|---|---|---|---|
| | Power | | Image Property | |
| Photosensitive Member | Transmission Side | Bearing Side | Flaw | Variation in Density |
| Photosensitive Member H | 29.5 (1.00) | 29.5 | x | ○ |
| Photosensitive Member I | 30.5 (1.03) | 29.5 | Δ | ○ |
| Photosensitive Member G | 33.0 (1.12) | 29.5 | ○ | ○ |
| Photosensitive Member J | 34.0 (1.17) | 29 | ○ | ○ |
| Photosensitive Member K | 37.5 (1.25) | 30 | ○ | Δ |
| Photosensitive Member L | 38.0 (1.27) | 30 | ○ | x |

As can be seen from Table 8, in the photosensitive members I, G, J, K in which proportion of thickness of the photoconductive layers at the side of the power transmission flange to the thickness at the side of the bearing flange was not less than 1.03 to 1 and not more than 1.25 to 1, neither flaw nor variation in density which may cause a practical problem was found. In each of the photosensitive members I, G, J, K, difference between the thickness of the photoconductive layer at the side of the power transmission flange and the thickness at the side of the bearing flange was not less than 1.0 μm and not more than 7.5 μm.

On the other hand, in the photosensitive member L in which the thickness of the photoconductive layer at the side of the power transmission flange was 1.27 times the thickness at the side of the bearing flange, variation in density in the axial direction of the member was found in the beginning of printing. In the photosensitive member H in which the thickness of the photoconductive layer was the same at the side of the power transmission flange and at the side of the bearing flange, after printing 300 thousand copies, flaws which may cause a practical problem were found in the printed images at the side of the power transmission flange of the photoconductive layer.

Thus, in the electrophotographic photosensitive member it is preferable that thickness of the photoconductive layer at the side of the power transmission flange is set to not less than 1.03 and not more than 1.25 times larger the thickness at the side of the bearing flange, and that the difference between the thickness of the photoconductive layer at the side of the power transmission flange and at the side of the bearing flange is set to not less than 1.0 μm and not more than 7.5 μm.

Example 5

In the present example, influence on the image property was studied, when changing the dynamic indentation hardness at the ends of the photosensitive layer of the electrophotographic photosensitive member.

(Manufacture of Electrophotographic Photosensitive Member)

An electrophotographic photosensitive member M (hereinafter referred to as "photosensitive member M") was manufactured by the same method as Example 1. specifically, an anti-charge injection layer and a photoconductive layer were formed on the surface of the cylindrical body 20 using the gas inlet tube 55' shown in FIG. 11 under film forming conditions shown in Table 1. Thereafter, a surface layer was laminated on the photoconductive layer using the gas inlet tube 55 shown in FIG. 6 under film forming conditions shown in Table 2.

In the gas inlet tube 55 shown in FIG. 6, the gas inlet ports 56 were arranged at short intervals in the area X (at the side of the inside low portion 24 to which the power transmission flange of the cylindrical body 20 is fixed), while arranged at long intervals in the area Y (at the side of the inside low portion 25 to which the bearing flange of the cylindrical body 20 is fixed).

As a comparative example, an electrophotographic photosensitive member N (hereinafter referred to as "photosensitive member N") was manufactured, by forming an anti-charge injection layer, a photoconductive layer, and a surface layer laminated to each other using only the gas inlet tube 55' shown in FIG. 11 under the film forming conditions shown in Tables 1 and 2. In the gas inlet tube 55' showing FIG. 11, a plurality of gas inlet ports 55' were arranged at substantially uniform intervals at the side of the inside low portion 24 to which the power transmission flange is fixed, and at the side of the inside low portion 25 to which the bearing flange is fixed.

(Measuring Dynamic Indentation Hardness of Photosensitive Layer)

The dynamic indentation hardness of the photosensitive layers were measured at end portions of the photosensitive members M, N (portions apart from the respective ends of the photosensitive members M, N by 40 mm in the axial direction), utilizing a Dynamic Ultra Micro Hardness Tester (Model (Number): DUH-201 manufactured by SHIMADZU CORPORATION). Table 9 shows the measurement results of dynamic indentation hardness of the photosensitive layers. The dynamic indentation hardness of each of the photosensitive layers was measured at any five points along the circumference of each of the photosensitive members, and the average value is shown in Table 9.

TABLE 9

| | Photosensitive Member M | | Photosensitive Member N | |
|---|---|---|---|---|
| | Power Transmission Side | Bearing Side | Power Transmission Side | Bearing Side |
| Hardness of Photosensitive Layer | 850 | 750 | 850 | 840 |

(Evaluation of Image Property)

The image property was evaluated by the same method as Example 1, after printing 300 thousand copies. The evaluation results are shown in Table 10. The evaluation standard of image property in Table 10 is the same as Example 1.

TABLE 10

| | | Photosensitive Member | | | |
|---|---|---|---|---|---|
| | | Photosensitive Member M | | Photosensitive Member N | |
| | | Evaluation Item | | | |
| | | Flaw | Variation in Density | Flaw | Variation in Density |
| Number of Printing | Beginning | ○ | ○ | ○ | ○ |
| | 5,000 | ○ | ○ | ○ | ○ |
| | 10,000 | ○ | ○ | ○ | ○ |
| | 50,000 | ○ | ○ | Δ | ○ |
| | 100,000 | ○ | ○ | x (Power Transmission Side) | ○ |
| | 300,000 | ○ | ○ | x (Power Transmission Side) | ○ |

As can be seen from Table 10, with the photosensitive member M in which the dynamic indentation hardness of the photosensitive layer was larger at the side of the power transmission flange than at the side of the bearing flange, neither flaw nor variation in density was found, and even after printing 300 thousand copies, images of good quality were obtained.

On the other hand, with the photosensitive member N in which the dynamic indentation hardness of the photosensitive layer was the same at the side of the power transmission flange and at the side of the bearing flange, after printing about 50 thousand copies, flaws were found at the side of the power transmission flange, and after printing not less than 100 thousand copies, flaws which may cause a practical problem were found.

The results show that the electrophotographic photosensitive member in which the photosensitive layer has dynamic indentation hardness larger at the side of the power transmission flange than at the side of the bearing flange is less likely to have a flaw in printed images, thereby having enhanced image property.

Example 6

In the present example, influence on the image property was studied, when changing the proportion of thickness of the photosensitive layer at the side of the power transmission flange to the thickness at the side of the bearing flange.

(Manufacture of Electrophotographic Photosensitive Member)

Electrophotographic photosensitive members O, P, Q, R were manufactured by the same method as Example 5. Specifically, an anti-charge injection layer and a photoconductive layer were formed on the surface of the cylindrical body 20 using the gas inlet tube 55' shown in FIG. 11 under film forming conditions shown in Table 1. Thereafter, a surface layer was laminated on the photoconductive layer using the gas inlet tube 55 shown in FIG. 6 under film forming conditions shown in Table 2.

The gas inlet tubes 55 for forming the surface layer had respective gas inlet ports arranged differently in the area X (see FIG. 6), so that the surface layers of the electrophotographic photosensitive members O, P, Q, R had different thickness at the side of the power transmission flange.

(Measuring Dynamic Indentation Hardness of Photosensitive Layer)

The dynamic indentation hardness of the photosensitive layers was measured at the same portions and by the same method as Example 5. Table 11 shows the measurement results of dynamic indentation hardness of the photosensitive layers, together with the dynamic indentation hardness of the photosensitive members M, N measured in Example 5.

(Evaluation of Image Property)

The image property was evaluated by the same method as Example 5, after printing 300 thousand copies. The evaluation results are shown in Table 11 together with the results of the photosensitive members M, N checked in Example 5.

TABLE 11

| | Film Thickness of SiC Surface Layer (μm) | | | |
|---|---|---|---|---|
| | Power | | Image Property | |
| Photosensitive Member | Transmission Side | Bearing Side | Flaw | Variation in Density |
| Photosensitive Member O | 850 (1.27) | 670 | ○ | x |
| Photosensitive Member P | 850 (1.25) | 680 | ○ | ○ |
| Photosensitive Member M | 850 (1.13) | 750 | ○ | ○ |
| Photosensitive Member Q | 860 (1.08) | 800 | ○ | ○ |
| Photosensitive Member R | 860 (1.03) | 835 | ○ | ○ |
| Photosensitive Member N | 850 (1.01) | 840 | x (Power Transmission Side) | ○ |

As can be seen from Table 11, in the photosensitive members P, M, Q, R in which proportion of the dynamic indentation hardness of the photosensitive layers at the side of the power transmission flange to the dynamic indentation hardness at the side of the bearing flange was not less than 1.03 to 1 and not more than 1.25 to 1, neither flaw nor variation in density which may cause a practical problem was found. In each of the photosensitive members P, M, Q, R, difference between the dynamic indentation hardness of the photosensitive layer at the side of the power transmission flange and the dynamic indentation hardness at the side of the bearing flange was not less than 25 and not more than 170.

On the other hand, in the photosensitive member O in which the dynamic indentation hardness of the photosensitive layer at the side of the power transmission flange was 1.27 times the dynamic indentation hardness at the side of the bearing flange, variation in density in the axial direction of the member was found in the beginning of printing. In the photosensitive member N in which the dynamic indentation hardness of the photosensitive layer at the side of the power transmission flange was substantially the same as (or 1.01 times) the dynamic indentation hardness at the side of the bearing flange, after printing 300 thousand copies, flaws which may cause a practical problem were found in the printed images at the side of the power transmission flange.

Thus, in the electrophotographic photosensitive member, it is preferable that dynamic indentation hardness of the photosensitive layer at the side of the power transmission flange is set to not less than 1.03 and not more than 1.25 times larger the dynamic indentation hardness at the side of the bearing flange.

The invention claimed is:

1. An electrophotographic photosensitive member rotatably supported in an image forming apparatus, comprising:

a substantially cylindrical body; and a photosensitive layer with a latent image forming area formed on the body;

wherein the photosensitive layer comprises a first end in an axial direction of the latent image forming area, and a second end located at an opposite to the first end in the axial direction, the first end is pressed harder than the second end when the electrophotographic photosensitive member is incorporated in the image forming apparatus, and thickness at the first end is larger than thickness at the second end.

2. The electrophotographic photosensitive member according to claim 1, wherein the body is rotated by a power transmitted to the first end.

3. The electrophotographic photosensitive member according to claim 1, wherein the photosensitive layer includes a photoconductive layer and a surface layer, and at least one of the photoconductive layer and the surface layer has a thickness larger at the first end than at the second end.

4. The electrophotographic photosensitive member according to claim 3, where in at least one of the photoconductive layer and the surface layer, a ratio of thickness at the first end to thickness at the second end is not less than 1.03 and not more than 1.25.

5. The electrophotographic photosensitive member according to claim 3, wherein in the photoconductive layer, a difference between the thickness of the photoconductive layer at the first end and the thickness at the second end is not less than 1.0 μm and not more than 7.5 μm.

6. The electrophotographic photosensitive member according to claim 3, wherein in the surface layer, a difference between thickness of the surface layer at the first end and the thickness at the second end is not less than 0.03 μm and not more than 0.21 μm.

7. The electrophotographic photosensitive member according to claim 3, wherein a thickness of at least one of the photosensitive layer and the surface layer gradually becomes larger as proceeding from the second end to the first end.

8. The electrophotographic photosensitive member according to claim 3, wherein a thickness of at least one of the photosensitive layer and the surface layer gradually becomes larger stepwise as proceeding from the second end to the first end.

9. The electrophotographic photosensitive member according to claim 3, wherein at least one of the photoconductive layer and the surface layer is made of a material containing inorganic material.

10. An electrophotographic photosensitive member rotatably supported in an image forming apparatus, comprising:

a substantially cylindrical body; and a photosensitive layer with a latent image forming area formed on the body;

wherein the photosensitive layer comprises:

a first end in an axial direction of the latent image forming area, and a second end opposite to the first end in the axial direction, the first end is pressed harder than the second end when the electrophotographic photosensitive member is incorporated in the image forming apparatus, and dynamic indentation hardness at the first end is larger than the dynamic indentation harness at the second end.

11. The electrophotographic photosensitive member according to claim 10, wherein in the photoconductive layer, a ratio of the dynamic indentation hardness of the photosensitive layer at the first end to the dynamic indentation hardness at the second end is not less than 1.03 and not more than 1.25.

12. The electrophotographic photosensitive member according to claim 10, wherein in the photoconductive layer, a difference between the dynamic indentation hardness of the photosensitive layer at the first end to the dynamic indentation hardness at the second end is not less than 25 and not more than 170.

13. The electrophotographic photosensitive member according to claim 10, wherein the dynamic indentation hardness of the photosensitive layer gradually becomes larger as proceeding from the second end to the first end.

14. The electrophotographic photosensitive member according to claim 10, wherein the dynamic indentation hardness of the photosensitive layer becomes larger stepwise as proceeding from the second end to the first end.

15. The electrophotographic photosensitive member according to claim 10, wherein the photosensitive layer includes a photoconductive layer and a surface layer.

16. The electrophotographic photosensitive member according to claim 15, wherein at least one of the photosensitive layer and the surface layer is made of a material containing inorganic material.

17. An image forming apparatus comprising:

an electrophotographic photosensitive member including a photosensitive layer formed on a substantially cylindrical body; and a pressing member for pressing a first end of the photosensitive layer at a first end harder than a second end at an opposite to the first end in an axial direction of the photosensitive layer;

wherein in the photosensitive layer, a thickness of the photosensitive layer at the first end is larger than a thickness at the second end.

18. The image forming apparatus according to claim 17, wherein the electrophotographic photosensitive member is rotated by a power transmitted to the first end.

19. The image forming apparatus according to claim 17, wherein the photosensitive layer includes a photoconductive layer and a surface layer, and at least one of the photoconductive layer and the surface layer has a thickness larger at the first end than at the second end.

20. The image forming apparatus according to claim 19, wherein in at least one of the photoconductive layer and the surface layer, a ratio of a thickness of at least one of the photoconductive layer and the surface layer at the first end to thickness at the second end is not less than 1.03 and not more than 1.25.

21. The image forming apparatus according to claim 19, wherein in the photoconductive layer, a difference between the thickness of the photoconductive layer at the first end and the thickness at the second end is not less than 1.0 μm and not more than 7.5 μm.

22. The image forming apparatus according to claim 19, wherein in the surface layer, a difference between the thickness of the surface layer at the first end and the thickness at the second end is not less than 0.03 μm and not more than 0.21 μm.

23. The image forming apparatus according to claim 19, wherein a thickness of at least one of the photoconductive layer and the surface layer gradually becomes larger as proceeding from the second end to the first end.

24. The image forming apparatus according to claim 19, wherein a thickness of at least one of the photoconductive layer and the surface layer becomes larger stepwise as proceeding from the second end to the first end.

25. The image forming apparatus according to claim 19, wherein at least one of the photoconductive layer and the surface layer is made of a material containing inorganic material.

26. The image forming apparatus according to claim 17, wherein the pressing member has a pressing portion for pressing the electrophotographic photosensitive member, the pressing portion having a JIS hardness (conform to JIS K6253 A with indenter mass of 180 g and indenter height of 2.5 mm) of not less than 67 degrees and not more than 84 degrees.

27. An image forming apparatus comprising:

an electrophotographic photosensitive member including a photosensitive layer formed on a substantially cylindrical body; and a pressing member for pressing the photosensitive layer at a first end harder than a second end at an opposite-side to the first end in an axial direction of the photosensitive layer;

wherein in the photosensitive layer, a dynamic indentation hardness at the first end at one side of the latent image forming area of the body is larger than a dynamic indentation hardness at the second end at the opposite side to the first end in the axial direction of the latent image forming area.

28. The image forming apparatus according to claim 27, wherein in the photosensitive layer, a ratio of dynamic indentation hardness of the photosensitive layer at the first end to dynamic indentation hardness at the second end is not less than 1.03 and not more than 1.25.

29. The image forming apparatus according to claim 27, wherein in the photosensitive layer, a difference between dynamic indentation hardness of the photosensitive layer at the first end and dynamic indentation hardness at the second end is not less than 25 and not more than 170.

30. The image forming apparatus according to claim 27, wherein the dynamic indentation hardness of the photosensitive layer gradually becomes larger as proceeding from the second end to the first end.

31. The image forming apparatus according to claim 27, wherein the dynamic indentation hardness of the photosensitive layer becomes larger stepwise as proceeding from the second end to the first end.

32. The electrophotographic photosensitive member according to claim 27, wherein the photosensitive layer includes a photoconductive layer and a surface layer.

33. The image forming apparatus according to claim 32, wherein at least one of the photoconductive layer and the surface layer is made of a material containing inorganic material.

34. The image forming apparatus according to claim 27, wherein the electrophotographic photosensitive member is rotated by a power transmitted to an end in the axial direction of the electrophotographic photosensitive member.

35. The image forming apparatus according to claim 34, further comprising a bearing portion allowing the rotation of the electrophotographic photosensitive member, the bearing portion being arranged at an end opposite to said end in the axial direction of the electrophotographic photosensitive member.

36. The image forming apparatus according to claim 27, wherein the pressing member has a pressing portion for pressing the electrophotographic photosensitive member, the pressing portion having a JIS hardness (conform to JIS K6253 A with indenter mass of 180 g and indenter height of 2.5 mm) of not less than 67 degrees and not more than 84 degrees.

* * * * *

UNITED STATES PATENT AND TRADEMARK OFFICE

CERTIFICATE OF CORRECTION

PATENT NO. : 7,623,810 B2
APPLICATION NO. : 11/588846
DATED : November 24, 2009
INVENTOR(S) : Fukunaga et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 503 days.

Signed and Sealed this

Twenty-sixth Day of October, 2010

David J. Kappos

David J. Kappos
*Director of the United States Patent and Trademark Office*